US006845882B2

(12) United States Patent
Todd

(10) Patent No.: US 6,845,882 B2
(45) Date of Patent: Jan. 25, 2005

(54) MULTIPRODUCT FUEL DISPENSER USING A COMMON METER

(75) Inventor: John Arnold Todd, Fort Wayne, IN (US)

(73) Assignee: Dresser, Inc., Addison, TX (US)

( * ) Notice: Subject to any disclaimer, the term of this patent is extended or adjusted under 35 U.S.C. 154(b) by 31 days.

(21) Appl. No.: 10/626,093

(22) Filed: Jul. 24, 2003

(65) Prior Publication Data

US 2004/0016474 A1 Jan. 29, 2004

Related U.S. Application Data

(63) Continuation of application No. 10/290,849, filed on Nov. 8, 2002, now abandoned, which is a continuation of application No. 10/098,024, filed on Mar. 13, 2002, now abandoned, which is a continuation of application No. 08/514,909, filed on Aug. 14, 1995, now abandoned.

(51) Int. Cl.[7] ..... B67D 5/00
(52) U.S. Cl. ..... 222/26; 222/71
(58) Field of Search ..... 222/26, 71

(56) References Cited

U.S. PATENT DOCUMENTS

| | | | | | |
|---|---|---|---|---|---|
| 1,954,906 | A | | 4/1934 | Whitlock | |
| 2,286,411 | A | | 6/1942 | Hazard | |
| 2,980,294 | A | * | 4/1961 | Sacco | 222/66 |
| 3,814,148 | A | * | 6/1974 | Wostl | 141/98 |
| 3,908,718 | A | * | 9/1975 | Bower | 141/59 |
| 4,083,387 | A | * | 4/1978 | Stieber et al. | 141/95 |
| 4,654,813 | A | | 3/1987 | Edlund et al. | |
| 4,831,866 | A | | 5/1989 | Forkert et al. | |
| 5,170,671 | A | | 12/1992 | Miau et al. | |
| 5,213,142 | A | | 5/1993 | Koch et al. | |
| 5,215,131 | A | | 6/1993 | Poy | |
| 5,325,706 | A | | 7/1994 | Grose | |

FOREIGN PATENT DOCUMENTS

| | | |
|---|---|---|
| EP | 0611015 | 8/1994 |

* cited by examiner

*Primary Examiner*—J. Casimer Jacyna
(74) *Attorney, Agent, or Firm*—Fish & Richardson P.C.

(57) ABSTRACT

A multiproduct fuel dispenser for dispensing a plurality of fuels stored in a plurality of reservoir tanks comprising a nozzle for dispensing fuel, fuel delivery lines for delivering fuel from the plurality of reservoir tanks to the nozzle, and a common fuel meter operatively connected to the fuel delivery lines for quantifying the amount of fuel dispensed from the plurality of reservoir tanks, the common fuel meter having an internal volume no greater than 0.1 gallons.

5 Claims, 1 Drawing Sheet

MULTIPRODUCT FUEL DISPENSER USING A COMMON METER

This application is a continuation of application Ser. No. 10/290,849 filed Nov. 8, 2002, now abandoned which was a continuation of application Ser. No. 10/098,024 filed Mar. 13, 2002, now abandoned which was a continuation of application Ser. No. 08/514,909, filed Aug. 14, 1995 now abandoned.

FIELD OF THE INVENTION

This invention relates to a multiproduct fuel dispenser and, more particularly, to such a dispenser that feeds more than one product through a common meter.

BACKGROUND OF THE INVENTION

Many gasoline service stations require the installation of multiproduct fuel dispensers or pumps, each for dispensing a plurality of different grades, or octane levels, of gasoline products at each fueling station. Conventionally, three different products are provided per fueling station, namely a high octane fuel, a medium octane fuel and a low octane fuel. Mixing of these various products can result in the dilution or lowering of the octane level of the high and medium octane fuels which can adversely affect the performance of the customer's automobile. Testing procedures have therefore been developed in the United States to certify the octane levels of the fuels dispensed from commercial fuel dispensers. The testing and certification procedures are set forth in the National Conference on Weights and Measures Publication No. 12, entitled "Examination Procedure Outlines for Weighing and Measuring Devices." Pursuant to these testing guidelines, the person conducting the test is required to flush at least 0.3 gallons of fuel from the dispenser before taking the test sample. See page 57, fn. 1. Thus, in dispensers used at United States gasoline service stations, a slight mixing of the various fuel products of a multiproduct fuel dispenser may occur, so long as the contaminated product is flushed from the system during the first 0.3 gallons of discharge.

To minimize the mixing of the various products dispensed from a multiproduct fuel dispenser, known dispensers typically include a separate flow path for each product from its reservoir product tank which stores the fuel to the outlet nozzle which introduces the fuel into the consumer's automobile. These systems therefore require the duplication of the components disposed between the tank and the nozzle for each fuel product, including the flow meter. In this manner, however, no contamination of the octane level of the products can occur. Such dispensers are known as "wet hose systems" as the hose, as well as the flow meter and other delivery components, remain filled with fuel from the most recent use. Through the use of such separate hoses, meters, etc., dispensers of the prior art avoid contamination of fuel being dispensed at a particular time with fuel from a previous use that would otherwise remain in the system at the termination of the last dispensing cycle. Spalding, U.S. Pat. No. 5,332,011, a patent assigned to the assignee of the present invention, discloses such a dispenser, in which three nozzles, fuel hoses and flow meters, each for a different grade of gasoline, are combined in a single dispenser.

There are many disadvantages in the use of discrete delivery systems for each product fed through a multiproduct fuel dispenser. For example, the cost of such dispensers is increased due to the requirement for multiple hoses, nozzles and meters. Also, the overall size and space requirements of such a dispenser are increased due to the requirement to house the multiplicative components. In addition, and especially with respect to the flow meters, the cost of maintenance and repairs is increased for each discrete delivery system included in such dispensers.

In an effort to overcome some of the above problems, multiproduct fuel dispensers have been developed that comprise tri-axial fuel hoses having three concentric passages within a single hose that lead to a single nozzle. Such devices simplify operation for the consumer as there is only a single nozzle, but they do not alleviate the need for separate flow meters for each product or improve the maintenance and repair costs. Moreover, such devices might actually increase the cost of the dispenser due to the complexity of the tri-axial hoses.

Other multiproduct fuel dispensers have been developed in which the supply lines from each reservoir tank are manifolded into a single fuel hose downstream of the flow meter, which hose then leads to a single nozzle. Although this eliminates the multiplicity of nozzles and hoses, the problems associated with the multiplicity of flow meters, such as complexity, space limitations, and repair and maintenance expenses, remain.

What is needed is a multiproduct fuel dispenser that uses a common flow meter for dispensing a multiplicity of fuels.

SUMMARY OF THE INVENTION

It is therefore an object of the present invention to provide a multiproduct fuel dispenser that uses a common meter for dispensing a multiplicity of fuels.

It is a further object of the present invention to provide a dispenser of the above type in which less than 0.3 gallons of fuel remains in the common fluid path of the dispenser following its use.

It is a still further object of the present invention to provide a dispenser of the above type in which either a single nozzle or multiple nozzles can be employed.

It is a still further object of the present invention to provide a dispenser of the above type in which the complexity, space limitations, original cost and repair and maintenance expenses are all reduced relative to current dispensers.

Towards the fulfillment of these and other objects, according to the multiproduct fuel dispenser of the present invention, a dispenser is provided having a single common fuel meter per fueling station for receiving a plurality of grades of fuel from fuel reservoir tanks. The internal volume of the fuel meter is such that no more than 0.1 gallons of fuel remain in the fuel meter after use of the dispenser. After passing through the fuel meter, the fuel can flow either through a common hose and nozzle to the customer's fuel tank, or alternatively, through separate hose and nozzle paths for each grade of fuel dispensed from the dispenser.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PRIOR ART

Figure 1:
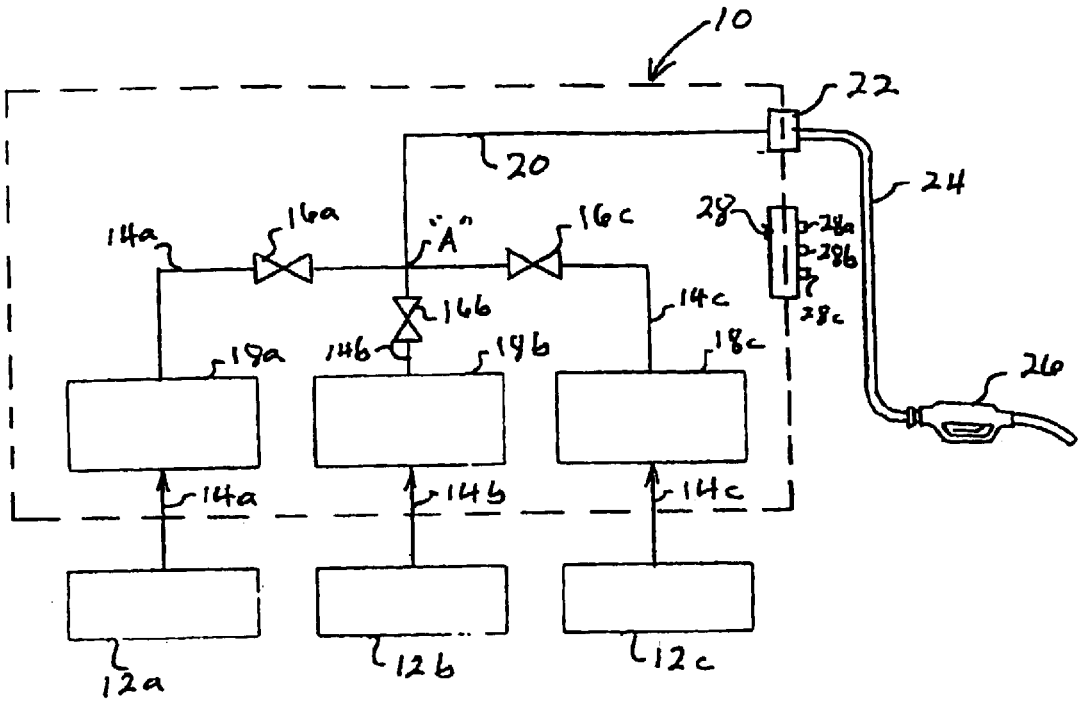
FIG. 1 (PRIOR ART)
FIG. 1 is a schematic view of a prior art dispenser.

Referring to FIG. 1 of the drawings, a prior art multiproduct fuel dispenser is shown schematically and generally referred to with reference numeral 10. The dispenser 10 receives fuel from a plurality of underground fuel reservoir tanks 12*a*–12*c*, each of which stores a different grade of fuel such as high, medium and low octane. Fuel from the reservoir tanks 12*a*–12*c* flows into the dispenser 10 via separate fuel delivery lines 14*a*–14*c*, each under the control of a flow control valve 16*a*–16*c*, respectively. Flow meters 18*a*–18*c* are disposed in each of the fuel delivery lines between each reservoir tank 12*a*–12*c* and its associated flow control valve 16*a*–16*c*, respectively. Each flow meter 18*a*–18*c* generates an output signal in proportion to the gasoline flow through such meter to allow the customer to control the total amount of fuel dispensed. The flow meters 18*a*–18*c* are conventional in design, and each could, for example, be a positive displacement meter comprising a fluid oscillator, a piezoceramic transducer and an electrical connector.

The fuel delivery lines 14*a*–14*c* converge downstream of the flow control valves 16*a*–16*c* at a convergence point "A" into a single fuel delivery line 20 which passes the fuel out of the dispenser 10 via an outlet casting 22. A flexible hose 24 extends from the outlet casting 22 and terminates in a nozzle 26 designed for insertion into a customer's automobile fuel tank (not shown). A product selection panel 28 having a plurality of buttons 28*a*–28*c* corresponding to the grades of fuel available through the dispenser 10 is mounted to the dispenser 10 and, together with the nozzle 26, controls the operation of the flow control valves 16*a*–16*c* in a conventional manner to allow the customer to select the desired grade of fuel from the reservoir tanks 12*a*–12*c*.

It should be understood that multiproduct fuel dispensers such as the dispenser 10 typically contain two fueling stations on opposing sides to service two customers at a time, each having a fuel delivery system as just described for dispensing fuel from the reservoir tanks 12*a*–12*c*. As such dispensing stations are identical, only one fueling station has been described.

In operation of the prior art dispenser 10, the customer places the nozzle 26 into the automobile fuel tank (not shown) and selects a desired grade of fuel, i.e. the fuel from reservoir tank 12*a*, from the product selection panel 28 by pressing the appropriate button 28*a*–28*c*, i.e. button 28*a*. This selection is electronically transferred from the product selection panel 28 to the appropriate flow control valve 16*a*–16*c* in a conventional manner, in this case flow control valve 16*a*. Then, when the customer activates the nozzle 26, the flow control valve 16*a* opens, thereby allowing fuel in the reservoir tank 12*a* to travel through the fuel delivery line 14*a*, through meter 18*a*, into the fuel delivery line 20 and the hose 24 and ultimately into the customer's fuel tank via the nozzle 26. The meter 18*a* tracks the amount of fuel flowing through the line, and thus the amount flowing into the customer's fuel tank, to enable the dispenser 10 to calculate the cost of the dispensed fuel. When the customer's fuel tank is full, or at anytime that the customer desires to stop the fuel delivery by deactivating the nozzle 26, the flow control valve 16*a* closes to stop the flow of fuel from the reservoir tank 12*a*.

Upon the stoppage of fuel delivery, the fuel delivery line 14*a*, the meter 18*a*, the flow control valve 16*a*, the fuel delivery line 20, the hose 24 and the nozzle 26 all remain full of fuel from the reservoir tank 12*a*. This causes no problem if the next customer also selects the fuel from the reservoir tank 12*a*, but if the fuel from either reservoir tank 12*b* or 12*c* is selected, then the reservoir tank 12*a* fuel remaining in the fuel delivery line 20, the hose 24 and the nozzle 26 will be commingled with the newly selected fuel, thereby causing a change in the dispensed fuel characteristics and octane level. As discussed above, testing procedures have been developed in the United States to certify the octane levels of the fuels dispensed from commercial fuel dispensers to force the manufacturers of multiproduct fuel dispensers to minimize such commingling. These testing and certification procedures allow only a slight mixing of the various fuel products of a multiproduct fuel dispenser to occur. More specifically, the contaminated product must comprise no more than 0.3 gallons of fuel.

In conventional multiproduct fuel dispensers such as the dispenser 10, the amount of fuel remaining in the hose 24, measured between and including the outlet casting 22 and the nozzle 26, is around 0.2 gallons. Conventional flow meters, such as the flow meters 18*a*–18*c*, contain in excess of 0.1 gallons of fuel after use, and thus conventional multiproduct fuel dispensers have required a separate flow meter for each fuel reservoir tank to meet the United States testing and certification procedures.

DESCRIPTION OF THE PREFERRED EMBODIMENTS

Figure 2:
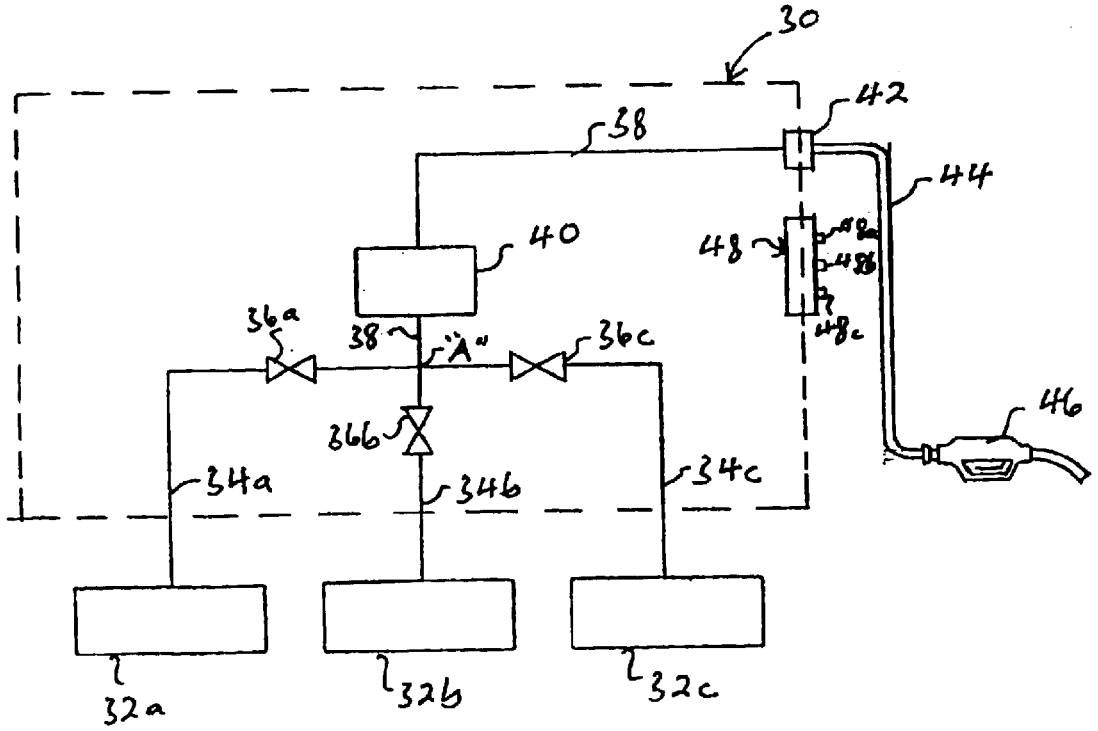
FIG. 2 is a schematic view of the dispenser of the present invention.

Referring now to FIG. 2, a multiproduct fuel dispenser of the present invention is shown schematically and generally referred to with reference numeral 30. The dispenser 30, like the prior art dispenser 10, receives fuel from a plurality of underground fuel reservoir tanks 32*a*–32*c*, each of which stores a different grade of fuel such as high, medium and low octane. Also like the prior art dispenser 10, separate fuel delivery lines 34*a*–34*c* pass the fuel from the reservoir tanks 32*a*–32*c* into the dispenser 30 under the control of flow control valves 36*a*–36*c*; however, in the dispenser 30 of the present invention, the fuel delivery lines 34*a*–34*c* converge into a single fuel delivery line 38 at a convergence point "A" upstream of a single flow meter 40. The flow meter 40 is disposed in the fuel delivery line 38, which line passes the fuel out of the dispenser 30 via an outlet casting 42. A flexible hose 44 extends from the outlet casting 42 and terminates in a nozzle 46 designed for insertion into a customer's automobile fuel tank (not shown). A product selection panel 48 having a plurality of buttons 48*a*–48*c* corresponding to the grades of fuel available through the dispenser 30 is mounted to the dispenser 30 and, together with the nozzle 46, controls the operation of the flow control valves 36*a*–36*c* in a conventional manner to allow the customer to select the desired grade of fuel from the reservoir tanks 32*a*–32*c*.

Like the flow meters 18*a*–18*c* of the prior art, the flow meter 40 generates an output signal in proportion to the gasoline flow through the meter to allow the customer to control the total amount of fuel dispensed; however, as opposed to flow meters of known multiproduct fuel dispensers, the fuel meter 40 of the present invention has a smaller internal volume such that no more than 0.1 gallons of fuel remains in the fuel meter 40 after use of the dispenser 30 as is further described below.

It should be understood that the dispenser 30 contains two fueling stations on opposing sides to service two customers at a time, each having a fuel delivery system as just described for dispensing fuel from the reservoir tanks 32*a*–32*c*. As such fueling stations are identical, only one station has been described. In addition, it should be emphasized that since FIG. 2 is merely a schematic representation of the basic components of the assembly of the present invention, the exact location, size and lengths of the components can vary within the scope of the invention. For example, the fuel meter 40 can be disposed in closer proximity to the outlet casting 42 to reduce the length of the fuel delivery line 38 in order to further reduce the amount of fuel remaining in the dispenser after use.

The operation of the dispenser 30 of the present invention is similar to the operation of the prior art dispenser 10 in that the customer selects a desired grade of fuel from the product selection panel 48 by pressing the appropriate button 48*a*–48*c*. This selection is electronically transferred from the product selection panel 48 to the appropriate flow control valve 36*a*–36*c* in a conventional manner. Then, when the customer activates the nozzle 46, the appropriate flow control valve 36*a*–36*c* opens, thereby allowing fuel from the selected reservoir tank 32*a*–32*c* to travel through its associated fuel delivery line 34*a*–34*c*, through the convergence point "A" into the fuel delivery line 38, and into the fuel meter 40. The fuel meter 40 tracks the amount of fuel flowing through the line, and thus the amount flowing into the customer's fuel tank via the hose 44 and the nozzle 46, to enable the dispenser 40 to calculate the cost of the dispensed fuel. When the customer's fuel tank is full, or at anytime that the customer desires to stop the fuel delivery by deactivating the nozzle 46, the activated flow control valve 36*a*–36*c* closes to stop the flow of fuel from the selected reservoir tank 32*a*–32*c*.

Upon the stoppage of fuel delivery, the selected fuel delivery line 34*a*–34*c* and flow control valve 36*a*–36*c*, the fuel meter 40, the fuel delivery line 38, the hose 44 and the nozzle 46 all remain full of fuel. Unlike the dispenser 10, however, the fuel remaining in the dispenser 30 is equal to or less than 0.3 gallons of fuel due to the reduced internal volume of the single fuel meter 40. In this manner, even if the next customer selects a different grade of fuel, only a slight commingling of fuels will occur. Thus, the dispenser 30 can pass the United States National Conference on Weights and Measures testing and certification procedures for octane certification as the remaining fuel (≦0.3 gallons) will be flushed from the dispenser 30 before the test sample is collected.

The multiproduct fuel dispenser 30 of the present invention thus provides several benefits and technical advantages over prior art dispensers. Foremost, by employing a single common fuel meter 40, both the original costs, and the expected repair and maintenance costs, of the dispenser 30 are reduced due to the elimination of relatively expensive and high maintenance component parts, such as multiple fuel meters. Moreover, as parts have been eliminated, the overall size and space requirements of the dispenser 30 are reduced. Importantly, these benefits and advantages are achieved with a multiproduct fuel dispenser that still passes the United States octane certification procedures as no more than 0.3 gallons of fuel remain in the dispenser 30 that can be commingled with fuels of different octane levels.

It should be understood that additional variations may be made to the preferred embodiment of the invention discussed above without departing from the spirit and scope of the present invention. For example, although the dispenser 30 has been described as having a single hose 44 and a single nozzle 46, the fuel delivery line 38 could be replaced with a plurality of fuel delivery lines, one for each product to be dispensed from the dispenser, for receiving fuel from the common fuel meter 40. Each such fuel delivery line would be attached to a separate hose and nozzle. In such a system, additional flow control valves would be required downstream of the flow meter 40, in addition to the flow control valves 36*a*–36*c*, to control the flow of fuel through the dispenser.

Further modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. An apparatus for dispensing fluid, comprising:

a meter;

at least one nozzle in communication with the meter;

a plurality fluid sources, each in communication with the meter; and a valve between one of the plurality of fluid sources and the meter; and wherein a fluid volume from the valve up to and including one nozzle is approximately 0.3 gallons or less.

2. The apparatus of claim 1 wherein at least two of the fluid sources supply fuel of differing grades.

3. The apparatus of claim 1 further comprising a valve between each of the plurality of fluid sources and the meter.

4. The apparatus of claim 3 further comprising a controller adapted to control the valves.

5. The apparatus of claim 1 wherein a fluid volume from a convergence point of a plurality of flow paths from the plurality of fluid sources up to and including one nozzle is approximately 0.3 gallons or less.

* * * * *

UNITED STATES PATENT AND TRADEMARK OFFICE

CERTIFICATE OF CORRECTION

PATENT NO. : 6,845,882 B2
DATED : January 25, 2005
INVENTOR(S) : John Todd

It is certified that error appears in the above-identified patent and that said Letters Patent is hereby corrected as shown below:

Column 6,
Line 49, should read -- 6. The apparatus of claim 1 wherein a fluid volume from an outlet of the meter up to and including one nozzle is approximately 0.2 gallons or less. --

Signed and Sealed this

Seventh Day of June, 2005

JON W. DUDAS
*Director of the United States Patent and Trademark Office*